US006454617B1

(12) United States Patent
Chiu

(10) Patent No.: US 6,454,617 B1
(45) Date of Patent: Sep. 24, 2002

(54) ELECTRICAL CONNECTOR WITH IMPROVED TERMINALS

(75) Inventor: Chin-Te Chiu, Banchiau (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 09/947,247

(22) Filed: Sep. 5, 2001

(51) Int. Cl.[7] ..... H01R 13/11
(52) U.S. Cl. ..... 439/857
(58) Field of Search ..... 439/857, 856

(56) References Cited

U.S. PATENT DOCUMENTS 4,083,623 A * 4/1978 Lynch ..... 439/857
4,379,611 A * 4/1983 Foege et al. ..... 439/857
5,263,833 A * 11/1993 Kirayoglu ..... 439/856
5,399,108 A * 3/1995 Lu et al. ..... 439/857
6,171,126 B1 * 1/2000 Wu et al. ..... 439/857
6,267,615 B1 * 7/2001 Lin ..... 439/857

* cited by examiner

*Primary Examiner*—Gary F. Paumen
(74) *Attorney, Agent, or Firm*—Wei Te Chung

(57) ABSTRACT

An electrical connector (4) includes an elongate molded plastic housing (50) with a pair of rows of terminal cavities (52) spaced along the length of the housing and a terminal (3) fitted in each cavity. Each terminal (3) includes an integral body (31) stamp-formed from thin metal strip. The body (31) comprises a front base (312) and a middle base (310). An elongate flat tail (318) extends longitudinally backwardly away from the body (31). A pair of spring arms (32, 34) extends upwardly from lateral sides of the middle base (310).

1 Claim, 3 Drawing Sheets

ELECTRICAL CONNECTOR WITH IMPROVED TERMINALS

FIELD OF THE INVENTION

The present invention relates to an electrical connector, and particularly to an electrical connector having terminals with improved structure for electrically connecting with inserted pin contacts.

BACKGROUND OF THE INVENTION

Generally, stamp-formed terminals designed to mate with inserted pins use single or dual cantilever contact arms with contact surfaces on the free ends of the arms. A pin inserted into a conventional terminal bends each arm along its length thereby deforming the arm as a cantilever beam and generating a contact force resiliently urging the contact surface against the side of the inserted pin. The cantilever beams extend along the length of the terminals and are limited in length by the height of the terminals.

U.S. Pat. No. 5,263,883 discloses a conventional connector with such a terminal. Referring to FIGS. 5 and 6, the conventional terminal 10 comprises a body 12 and a pair of spring members 22, 24. The body 12 includes a housing mounting plate 16 and a pair of flat terminal tails 18 and 20 extending longitudinally away from the body 12. The pair of spring members 22, 24 extend perpendicularly away from one side of the body 12. Each spring member 22, 24 includes a first arm 28 extending perpendicularly away from the body 12, a second arm 130 joined to the outer end of arm 28 and extending perpendicularly therefrom in a direction parallel to the longitudinal axis of the terminal, and a rigid arm 132 joining the outer end of arm 130 and extending perpendicularly in a direction back toward the body 12.

However, the spring members 22, 24 are shaped with rigid profile in longitudinal direction, such that when a pin contact of a mating connector is inserted in longitudinal direction between the spring members 22, 24, if there is a slight offset between the pin and spring members 22, 24, the body 12 will suffer a large mating force.

Thus the terminal 10 need be precisely mounted in the electrical connector for reducing unduly large mating force. However, manufacturing cost will therefore increase.

BRIEF SUMMARY OF THE INVENTION

A main object of the present invention is to provide an electrical connector having an improved terminal structure for reducing mating force when engaging with a mating connector.

Another object of the present invention is to provide a terminal with a simplified structure for reducing mating force when mating with an inserted pin contact.

To fulfill the above-mentioned object, according to a preferred embodiment of present invention, an electrical connector comprises an elongate molded plastic housing with a pair of rows of terminal cavities spaced along the length of the housing and a terminal fitted in each cavity. Each terminal comprises an integral body stamp-formed from thin metal strip. The body comprises a front base and a middle base. An elongate flat tail extends longitudinally backwardly away from the body. A pair of spring arms extend upwardly from lateral sides of the middle base.

Each spring arm comprises an arched S-shaped cantilever portion upwardly extending from the middle base. A pin contact portion extends forwardly from the curved cantilever portion. The pin contact portion is bent inwardly to form a contact ridge so that the contact portions are spaced more closely together than parallel cantilever portion. The cantilever portion is formed with an arched S-shaped profile for providing a flexible electrical connection with an inserted pin contact. The contact portion is tapered with a minimum width adjacent the cantilever portion and a maximum width adjacent its outer end.

Other objects, advantages and novel features of the invention will become more apparent from the following detailed description when taken in conjunction with the accompanying drawings.

DETAILED DESCRIPTION OF THE INVENTION

Figure 1:
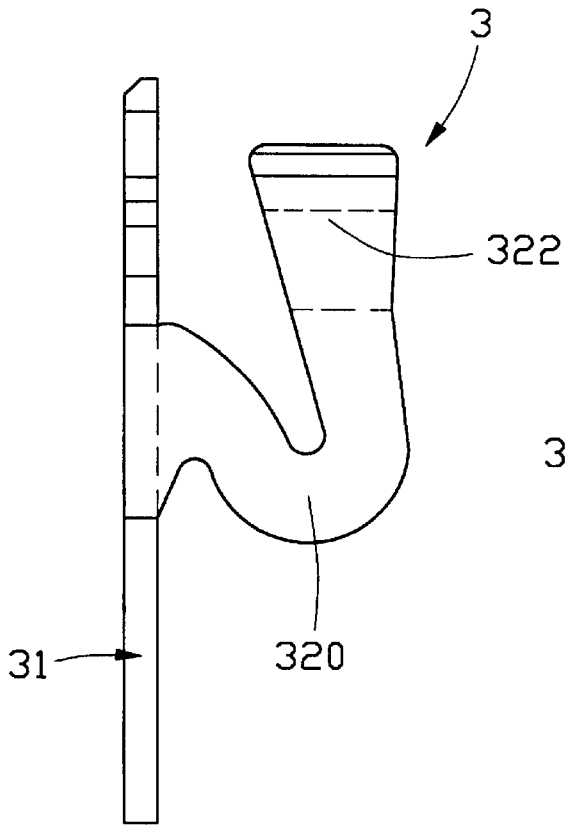
FIG. 1 is a side view of a terminal according to the invention.
Figure 2:
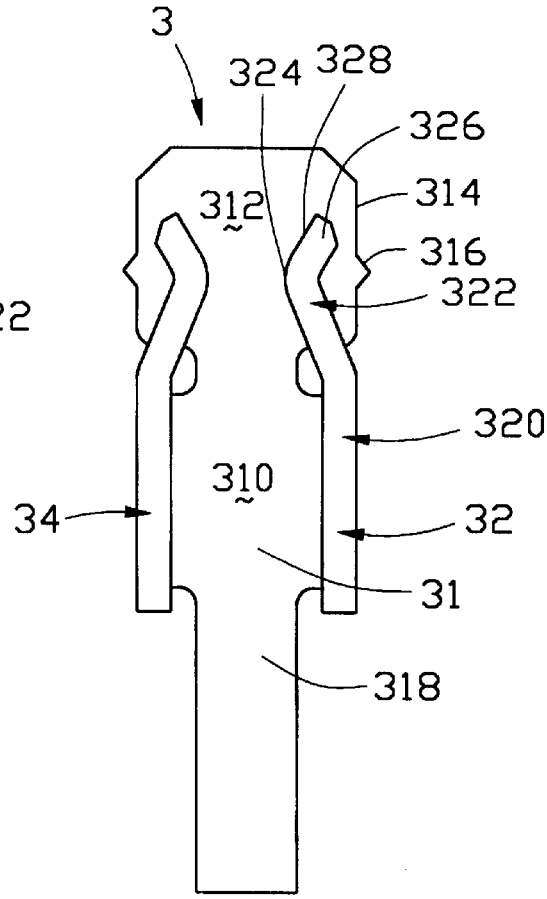
FIG. 2 is a top view of the terminal of FIG. 1.

Referring to FIGS. 1 and 2, a terminal 3 comprises an integral body 31 stamp-formed from thin metal strip. The body 31 comprises a front base 312 and a middle base 310. An elongate flat tail 318 extends longitudinally backwardly away from the body 31. A pair of spring arms 32, 34 extend upwardly from lateral sides of the middle base 310.

Each spring arm 32, 34 comprise an arched cantilever portion 320 upwardly extending from the middle base 310. A pin contact portion 322 extends forwardly from the curved S-shaped cantilever portion 320. The pin contact portion 322 is bent inwardly to form a contact ridge 324 so that the contact portions 322 are spaced more closely together than parallel cantilever portion 320. The cantilever portion 320 is formed with an arched profile for providing a flexible electrical connection with an inserted pin contact (now shown). The contact portion 322 is tapered with a minimum width adjacent the cantilever portion 320 and a maximum width adjacent its outer end.

The spring arms 32, 34 are shaped with high compliance and compensate for the uncertainty concerning due to the production tolerances inherent in stamp-forming of very small parts. Since dimensional variations in very small stamp-formed terminals are considerably greater than dimensional variations encountered in larger terminals.

Figure 4:
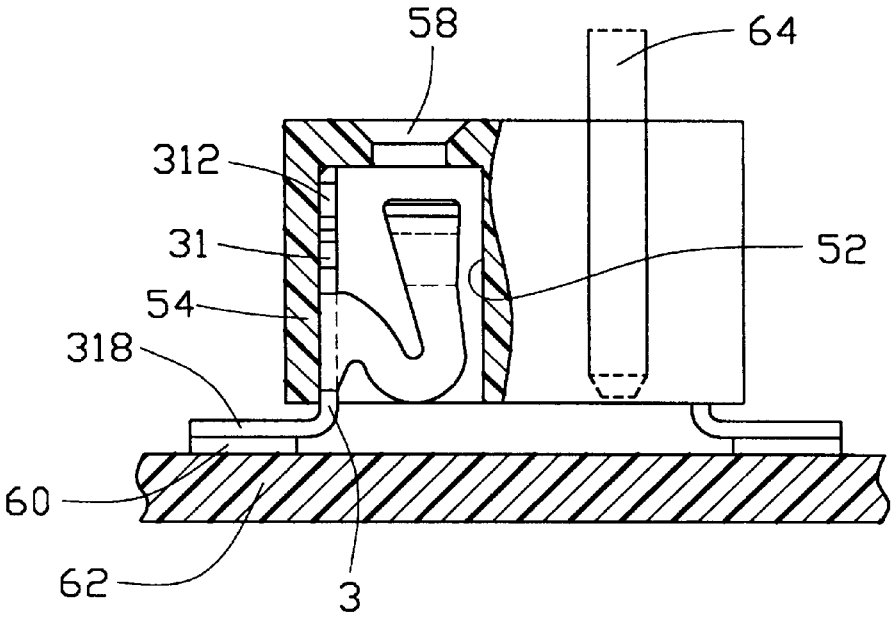
FIG. 4 is a cross-sectional view taken along line 4—4 of FIG. 3.
Figure 5:
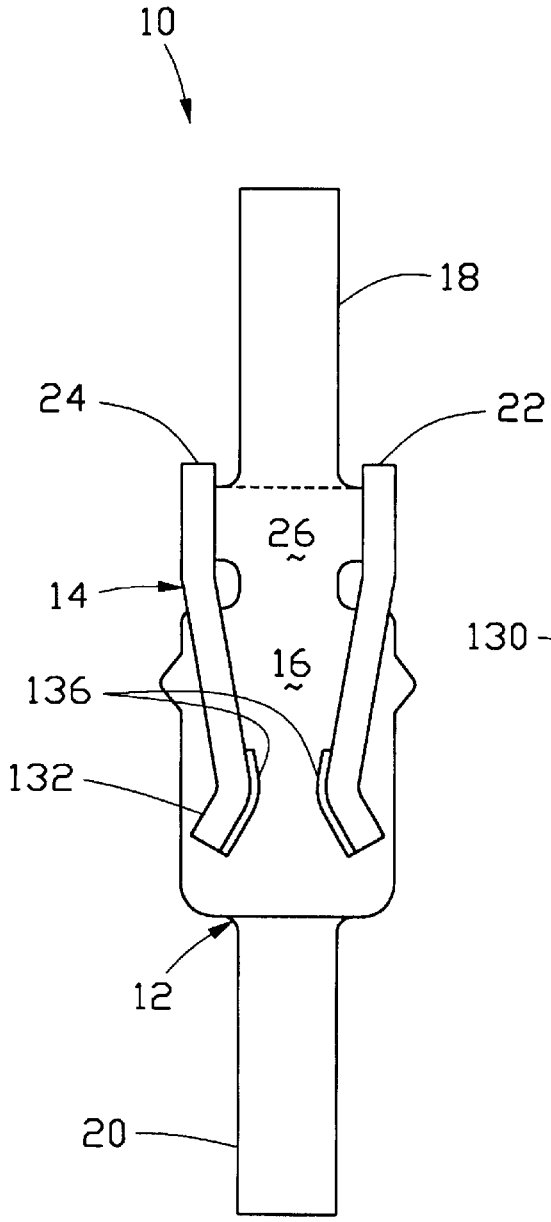
FIG. 5 (PRIOR ART)
FIG. 5 is a top view of a conventional terminal.
Figure 6:
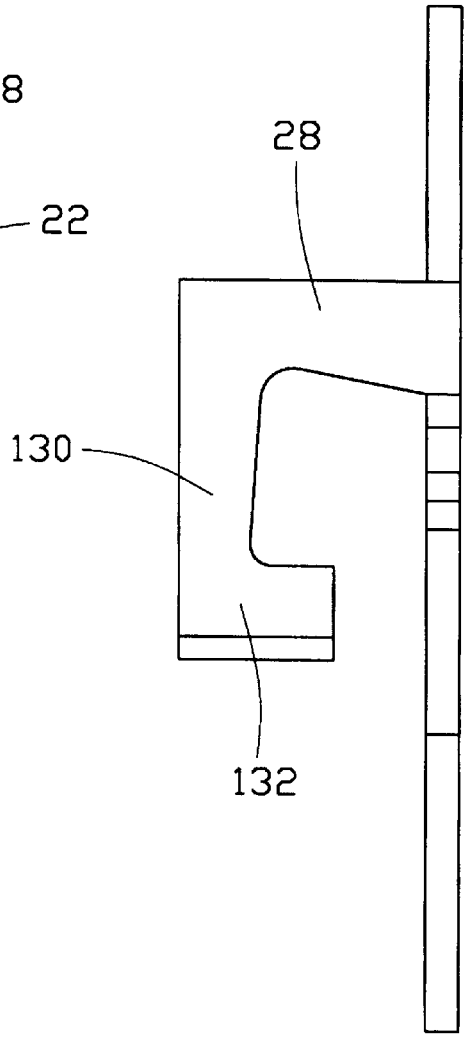
FIG. 6 (PRIOR ART)
FIG. 6 is a side view of FIG. 5.

The outer edges 314 of the front base 312 are fitted in grooves formed in cavities in an insulated plastic housing (FIG. 4). Projections 316 on the edges bite into the plastic in the groove to retain the terminal in place within the housing.

Figure 3:
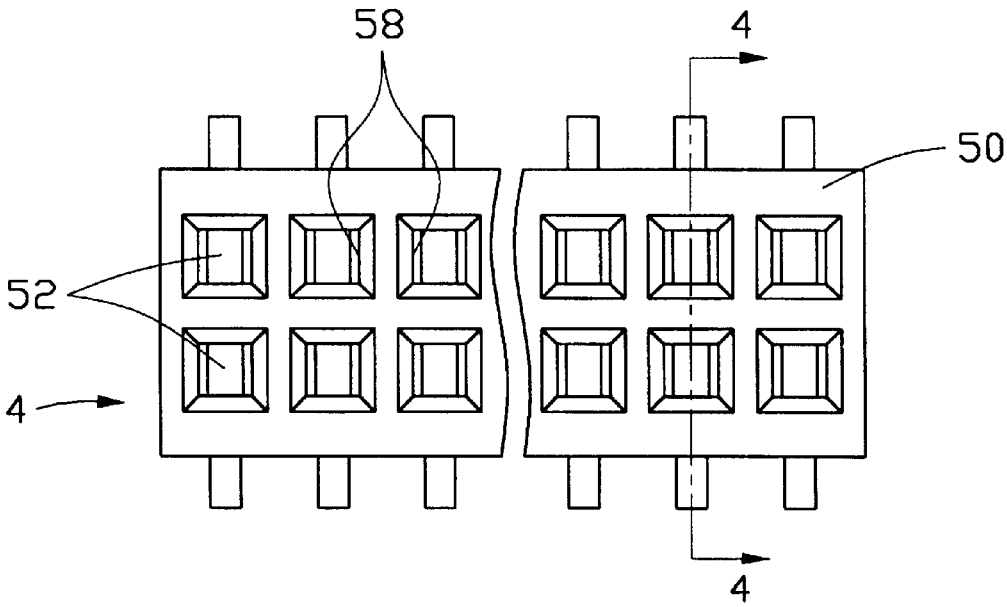
FIG. 3 is a top view of the terminal assembled to an electrical connector.

FIGS. 3 and 4 illustrate a top-mating terminal connector block 4 having an elongate molded plastic housing 50 with a pair of rows of terminal cavities 52 spaced along the length of the housing 50 and a terminal 3 fitted in each cavity. The middle base 310 and front base 312 of each terminal 3 rest flush against one end wall of the cavity 52 with edges 314 fitted in slots on either side of the cavity formed by the adjacent cavity end wall 54 formed in the cavity sidewalls adjacent the end wall and located a short distance from the end wall 54. The projections 316 bite into the sides of the cavities to hold the terminals 3 within the cavities. Chamfered pin insertion openings 58 are formed in the tip of the housing above the ends 326 of the contact portion 322.

With terminals 3 inserted in cavities 52 as described, the terminal middle base 310 and front base 312 are held flush against wall 54 and both spring arms 32, 34 extend freely into the cavity 52. The members are free to flex and do not engage the surfaces of the cavity during insertion or retention of a contact pin into the cavity through opening 58.

As illustrated in FIG. 4, the terminal tails 31 are bent 90 degrees from the positions of FIGS. 1 and 2, and are appropriately bonded to contact pads 60 on support member 62. The support member 62 may be a printed circuit board. The terminals 3 in connector 4 form electrical connections with two rows of square contact pins extending outwardly from a pin header of conventional design (not shown). The chamfered ends of individual pins 64 are inserted through pin openings 58 and into the cavities above the ends of contact portion 322. Further movement of the pins into the cavities move the ends into engagement with the beveled surfaces 328 on the sides of the contact portion 322 facing openings 58 to spread the spring arms apart. Thus, an electrical connection is formed between the mating connectors.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a plurality of cavities; and a plurality of terminals received in the cavities, each terminal comprising:

a body including a middle base, a front base forwardly extending from the middle base, and a tail portion backwardly extending from the middle base; and a pair of spring arms upwardly extending from lateral sides of the middle base, each spring arm having an arched cantilever portion and a pin contact portion extending forwardly from the cantilever portion;

wherein the cantilever portion of the spring arm extends from a lateral edge of the middle base with an arched S-shaped profile;

wherein the contact portion is bent inwardly to form a contact ridge;

wherein the distance between the contact portions of the two spring arms is spaced more closely together than that of the cantilever portions.

* * * * *